US006709181B1

(12) United States Patent
Montoli

(10) Patent No.: US 6,709,181 B1
(45) Date of Patent: Mar. 23, 2004

(54) MASCARA PRODUCT SAMPLER

(75) Inventor: Antonio Montoli, Brookfield, CT (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 6 days.

(21) Appl. No.: 10/412,149

(22) Filed: Apr. 11, 2003

(51) Int. Cl.[7] ..... A46B 11/00
(52) U.S. Cl. ..... 401/129; 401/126; 401/122
(58) Field of Search ..... 401/129, 121, 401/122, 126, 128, 130, 118, 124; 132/317

(56) References Cited

U.S. PATENT DOCUMENTS 2,849,739 A * 9/1958 Dresden ..... 401/128
3,209,387 A * 10/1965 Lukesch ..... 401/4
3,684,387 A * 8/1972 Glenn ..... 401/122
5,687,862 A * 11/1997 Barbier et al. ..... 215/40

* cited by examiner

*Primary Examiner*—David J. Walczak

(57) ABSTRACT

An applicator for the application of a cosmetic medium, such as mascara has a reservoir with an open end and a closed end and a frustoconical threaded socket in the open end. The applicator further includes a cap assembly which has a cap end and a frustoconical threaded plug. The frustoconical threaded plug is sized to mate sealingly with the frustoconical threaded socket of the reservoir and has a stem projecting axially from the plug. A cosmetic applicator is mounted to the stem and a reservoir insert is fitted inside the reservoir below the frustoconical threaded socket. The reservoir insert has a wiping orifice sized and shaped to wipe the cosmetic applicator.

16 Claims, 2 Drawing Sheets

MASCARA PRODUCT SAMPLER

FIELD OF THE INVENTION

The present invention relates to the design of a cosmetic package and more particularly to the design of a cosmetic package for mascara.

BACKGROUND OF THE INVENTION

In the manufacturing of cosmetic packages, there are substantial expenses that are inherent in producing different packages from the same manufacturing facility. These expenses include the design costs of developing multiple packages, and the tooling costs associated with each different package design. Different manufacturing dies may be needed for different packages. There are also manufacturing costs associated with the reconfiguration of the production machines for a run of packages that varies from the previous run of packages. Extruder dies, molds, cutter heads, guides, fence settings, tool program settings and the like may need to be changed to adapt the tool or tools to the new physical dimensions of the package to be manufactured. This retooling and reconfiguration increases cost of the delivered product.

The costs of alternative package designs may be reasonably amortized over a large production order or series of orders. However, in small manufacturing orders, these costs are substantial. A typical example is a small production run to manufacture brush sample mascara packages to be used by consumers and others in testing a new product or new package configuration. Mascara formulations may differ from company to company, and each formulation may require a different brush, with a potentially different brush stem and brush wiper. It would be desirable to provide the manufacture of sample mascara brush packages with a flexible design that can be changed with a change of the mascara formulation with minimal effort. This will benefit the package manufacturer, who may be expected to provide inexpensive sample brushes, or the cosmetic company, who may wish to purchase and consumer test a variety of different mascara formulation brush combinations, without incurring the expense associated with a full package design and manufacture.

Consequently, what mascara brush package manufacturers need is a more universal and flexible design for mascara brush packages that would allow sampling of different mascara fluid/brush combinations thereby reducing the manufacturing expenses associated with different mascara brush packages. This flexible design should have a reduced parts count, be interchangeable into a number of design configurations, and minimize the need for changes in the manufacturing process when components are changed.

SUMMARY OF THE INVENTION

Accordingly, it is an object of the present invention to provide a universal and flexible design for mascara brush packages, and more particularly to provide a standard design for a mascara brush sampler.

It is another object of the present invention to provide a mascara brush package that will have a reduced parts count but with all the functionality of a custom designed mascara brush package.

It is still a further object of the invention to provide a mascara brush package that can be used in a number of configurations without alteration of the base package design and with a standard manufacturing process.

To overcome the deficiencies of the past and present package designs and to achieve the objects and advantages listed above, a package design is disclosed which includes a reservoir having an open end and a closed end, with a frustoconical threaded socket at the open end; and a cap assembly having a cap end and a frustoconical threaded plug. The cap frustoconical threaded plug is sized to mate sealingly with the frustoconical threaded socket of the reservoir when the cap assembly is rotated relative to the reservoir. The cap frustoconical threaded plug has a stem projecting axially from the plug. A cosmetic applicator is mounted to the stem and a reservoir insert is fitted inside the reservoir below the frustoconical threaded socket. The reservoir insert has a wiping orifice sized and shaped to wipe the cosmetic applicator. In a preferred embodiment, the stem has a central bore at its free end, and a cosmetic brush assembly is mounted to the stem by fitting into the stem central bore.

Embodiments of the invention and their particular features and advantages will become more apparent from the following detailed description when considered with reference to the accompanying drawings.

DETAILED DESCRIPTION OF THE DRAWINGS

In the following drawings the same elements are identified by the same reference numbers. It should also be noted that for the sake of clarity, all the components and parts of the package assembly might not be shown and/or marked in all the drawings.

Figure 1:
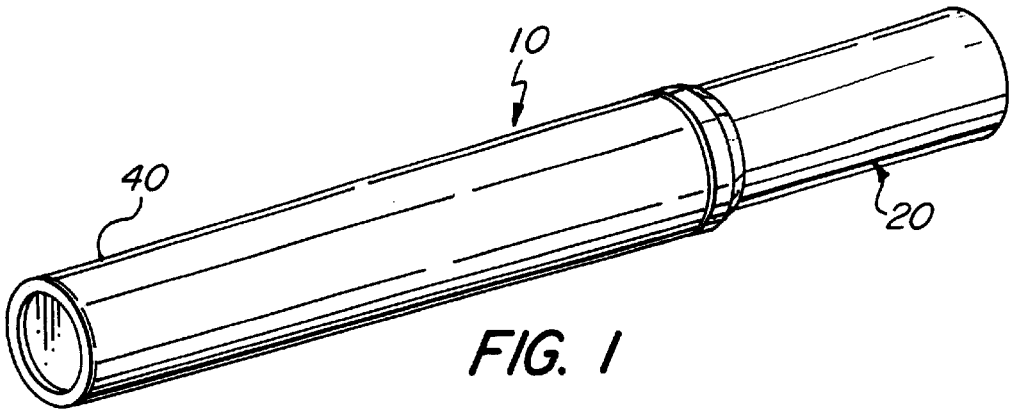
FIG. 1 is a perspective view of a cosmetic package assembly in accordance with the present invention.

Referring now to FIGS. 1–7, package assembly in accordance with the present invention is shown and generally designated by the reference numeral 10. As best shown in FIG. 1, package assembly 10 comprises two main components, cap assembly 20 and reservoir 40 which are designed to be interlocked forming a fluid proof seal. The seal is obtained by use of a mating set of male 34 (FIG. 3) and female 44 (FIG. 7) frustoconical surfaces. The result of the mating frustoconical male/female surfaces 34, 44 is to create a wedging effect between cap 20 and reservoir 40 as the two package components are screwed together into an interlocked package assembly.

This wedging effect creates a seal that is analogous to a cork in bottle. Therefore, as cap 20 and reservoir 40 are screwed together, the frustoconical surfaces will seat against each other to form a seal due to the compression created by the matched male/female frustoconical design. It is not important which side, cap 20 or reservoir 40, inserts into the other in order to form the interlocking coupled joint. For example, in one embodiment, the cap may be inserted into the reservoir to form the interlocking seal; in another embodiment, the reservoir may be inserted into the cap to form the interlocking seal.

Referring now to FIGS. 1–7, the cap assembly 20 has a cap end 24 for gripping by a mascara package user, and a frustoconical plug 21. The reservoir 40 has an open end 41 and a closed end 43. Open end 41 of the reservoir 40 has a frustoconical socket 45. The frustoconical plug 21 of the cap assembly 20 is sized to sealingly engage with the frustoconical socket 45 of the reservoir 40. In particular, the male frustoconical surface 34 of frustoconical plug 21 sealing bears against the female frustoconical surface 44 of socket 45 of reservoir 40.

Frustoconical plug 21 of the cap assembly has a stem 28 projecting axially from the frustoconical plug end 22. A cosmetic applicator 23 is mounted to the stem 28. The applicator may be mounted to the stem 28 by any number of means as are known in the art, such as by interfitting parts, gluing, melting. Preferably, the stem 28 is provided with a bore 36 in the stem 28, with bore 36 being open at one free end 38 of the stem 28.

Figure 2:
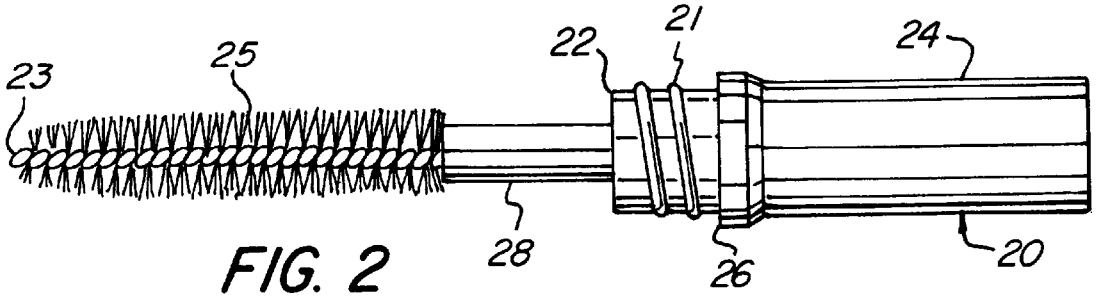
FIG. 2 is a side elevation view of a cosmetic applicator cap and brush in accordance with an embodiment of the invention.
Figure 3:
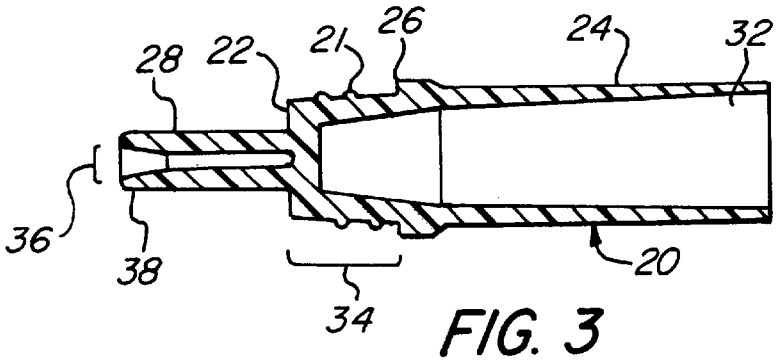
FIG. 3 is a cross sectional view of an embodiment of an applicator cap in accordance with an embodiment of the invention.
Figure 4:
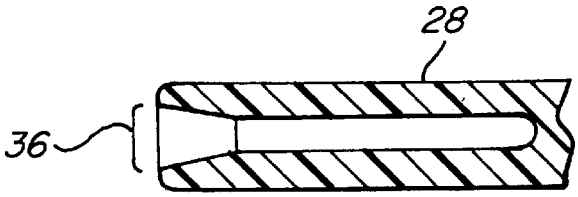
FIG. 4 is a detailed cross sectional view of a stem end of the applicator cap of FIG. 3.
Figure 5:
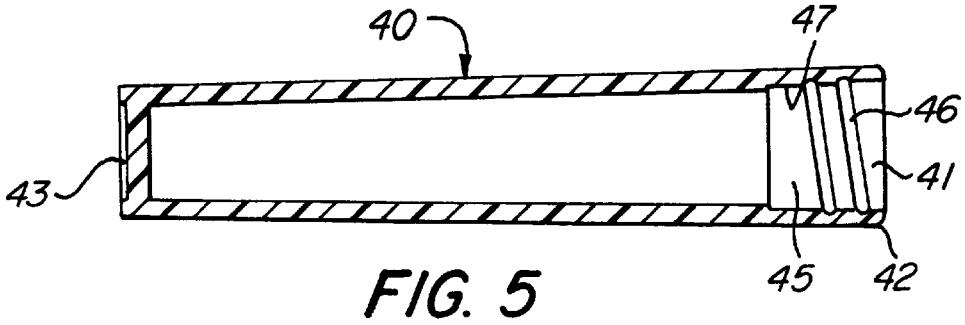
FIG. 5 is a cross sectional view of an embodiment of an applicator reservoir in accordance with an embodiment of the invention.
Figure 6:
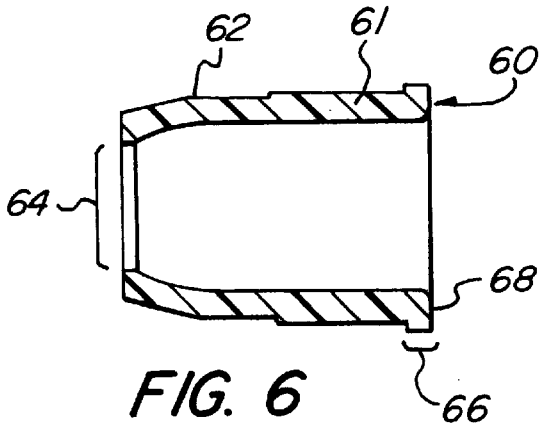
FIG. 6 is a cross sectional view of a reservoir insert.

The cosmetic applicator may be a twisted wire containing short bristles to form twisted wire brush assembly as shown at 25 in FIG. 2, or it may be a soft applicator such as a foam cosmetic applicator, or a hard applicator such as a stylus or a comb, or a fine brush such as a nail polish brush, or another type of applicator as is known in the industry.

A reservoir insert 60 is fitted inside the reservoir 40 below the frustoconical socket 45. Reservoir insert 60 has a wiping orifice 64 sized and shaped to wipe the cosmetic applicator. Reservoir insert 60 can be held in place in reservoir 40 by different methods. For example, reservoir insert 60 in one embodiment can be held in place by an interference fit. Another embodiment of the invention will utilize a mounting rim 66 that snap fits into an annular channel in the inner walls of reservoir 40. Other embodiments of reservoir insert 60 will be held in place by adhesives or other retaining structures or combinations of the foregoing methods of holding reservoir insert 60 in reservoir 40. Preferably, the reservoir insert 60 snap fits in the reservoir 40, and preferably is retained in the reservoir 40 by a mounting rim 66 at an upper end thereof. Mounting rim 66 snap fits into an annular lip or channel 47 extending around an inner surface of the reservoir 40. The distal end of reservoir insert 60 has orifice 64 whose dimensional size is calibrated to control the amount of product that goes on mascara brush 25. Therefore, orifice 64 functions as a wiper for the package brush 25 and changing the dimensions of orifice 64 will either remove more product or less product from package brush 25. Consequently, multiple package designs can be realized utilizing the same cap 20 and stem 28 and reservoir 40 but using different brushes 25 and reservoir inserts 60 of different sizes of orifice 64. Reservoir insert 60 preferably has a cylindrical upper section 61 and a tapering or frustoconical lower section 62. The tapering section has a small amount of give or flex to allow the cosmetic applicator to be closely wiped.

Plug end 22 of frustoconical plug 21 sealingly seats against the upper end 68 of the reservoir insert 60. The sealing fit of the plug end 22 of frustoconical plug 21 against the upper end 68 of the reservoir insert 60 provides a secondary sealing of the cap 20 to the reservoir 40.

The travel of the male frustoconical surface 34 of frustoconical plug 21 into the female frustoconical surface 44 is preferably controlled by a stop. The stop can have any form. For example, the stop can be realized by the compression of the frustoconical surfaces, i.e., the male surface will travel into the female surface no further than the compressibility of the material from which they are formed. An alternative stop design is for cap 20 to have a shoulder 26 which bears against the end 42 of reservoir 40. This bearing of shoulder 26 against the end 42 of reservoir 40 also provides a secondary sealing of the cap 20 to the reservoir 40.

As noted above, the reservoir insert 60 (shown in FIG. 6) also may serve as a stop that controls the seal seating of the frustoconical surfaces. In this embodiment, the plug end 22 of cap 20 stops against the upper end 68 of insert 60.

The frustoconical plug 21 and the frustoconical socket 45 of the reservoir 40 are preferably provided with mating screw threads to secure the reservoir 40 together with the cap assembly 20. However, other mating male and female retaining structures could be used, such as threads/threads recesses, snap-ring/snap-ring recess, snap-tabs/snap-tab recess, snap-ridges/snap-ridges recess and the like.

Figure 7:
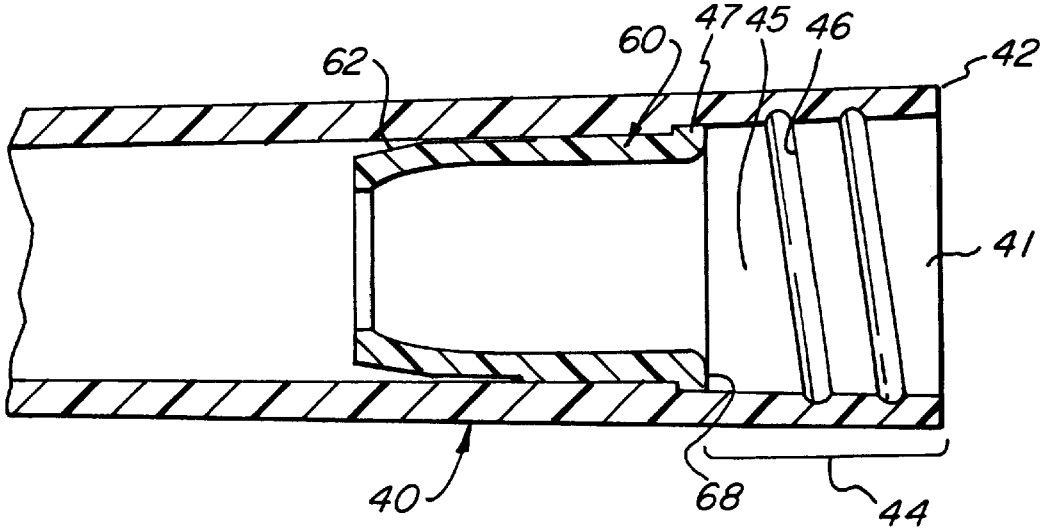
FIG. 7 is a cross sectional view of the reservoir insert of FIG. 6 assembled with the reservoir of FIG. 5.

It is not important which side carries the male or female retaining structure as long as the final cosmetic package assembly has a complete set of matched male/female retaining structures. In the preferred embodiment these retaining structures are mating male threads (as shown in FIG. 2) and female thread channels 46 (as shown in FIG. 7). Threads are found on the frustoconical surface 34 of cap 20 and the matched set of thread recesses 46 are found on reservoir 40.

The ability to create this sealed joint between cap 20 and reservoir 40 is a major advantage for the manufacturer because now the manufacturer does not have to add gasketing material and/or o-rings, other sealing means, for example, in order to insure a fluid tight seal in package assembly 10 as are needed in present package assembly designs. This means the manufacturer can reduce the number of parts in package assembly 10, which translates to a more cost efficient design.

The present mascara sample reduces the number of parts and manufacturing steps and is cost efficient to manufacture.

In addition, the mascara sampler of the present invention allows use of a standard package that can be adapted to different mascara formulations. In the embodiment of the present invention shown in the Figures, package stem 28 is a standard size that fits bore 36 of cap 20. Since the cap 20, reservoir 40, and component parts such as the package stem 28 and bore 36 are standardized, the number of package designs that can be fabricated using a single cap 20 design is increased and therefore the cost to manufacture multiple package designs is reduced. The only changes that are necessary to accommodate different mascara formulations are changes to the brush 25 design and/or the wiper orifice 64 of reservoir insert 60.

It should also be understood that the invention has been described for use with cosmetic packages for the sake of convenience only and is not intended to be limiting. Also, although the invention has been described with reference to a particular arrangement of parts, features and the like, these are not intended to exhaust all possible arrangements or features, and indeed many other modifications and variations will be ascertainable to those skilled in the art.

What is claimed is:

1. A cosmetic applicator assembly, consisting essentially of:

a reservoir, said reservoir having an open end and a closed end, said open end having a frustoconical threaded socket;

a cap assembly, said cap assembly having a cap end and a frustoconical threaded plug, said frustoconical threaded plug being sized to mate sealingly with said frustoconical threaded socket of said reservoir, said frustoconical threaded plug having a stem projecting axially from said frustoconical threaded plug;

a cosmetic applicator mounted to said stem; and a reservoir insert fitted inside said reservoir below said frustoconical threaded socket, said reservoir insert having a wiping orifice sized and shaped to wipe said cosmetic applicator.

2. A cosmetic applicator assembly in accordance with claim 1, wherein said frustoconical threaded plug has a plug end located to sealingly bear against an upper end of said reservoir insert.

3. A cosmetic applicator assembly in accordance with claim 1, wherein said cap assembly has a shoulder located to sealingly bear against an end of said reservoir.

4. A cosmetic applicator assembly in accordance with claim 1, wherein said reservoir insert is retained in said reservoir by a mounting rim at an upper end thereof, said mounting rim being snap fitted into an annular channel extending around an inner surface of said reservoir.

5. A cosmetic applicator assembly, consisting essentially of:

a reservoir, said reservoir having an open end and a closed end, said open end having a frustoconical threaded socket;

a cap assembly, said cap assembly having a cap end and a frustoconical threaded plug, said frustoconical threaded plug being sized to mate sealingly with said frustoconical threaded socket of said reservoir when said cap assembly is rotated relative to said reservoir, said frustoconical threaded plug having a stem projecting axially from said plug, said stem having a central bore at its free end;

a cosmetic brush assembly mounted to said stem by fitting into said stem central bore; and a reservoir insert fitted inside said reservoir below said frustoconical threaded socket, said reservoir insert having a wiping orifice sized and shaped to wipe said cosmetic brush assembly.

6. A cosmetic applicator assembly in accordance with claim 5, wherein said frustoconical threaded plug has a plug end located to sealingly bear against an upper end of said reservoir insert.

7. A cosmetic applicator assembly in accordance with claim 5, wherein said cap assembly has a shoulder located to sealingly bear against an end of said reservoir.

8. A cosmetic applicator assembly in accordance with claim 5, wherein said reservoir insert is retained in said reservoir by a mounting rim at an upper end thereof, said mounting rim being snap fitted into an annular channel extending around an inner surface of said reservoir.

9. A cosmetic applicator assembly, comprising:

a reservoir, said reservoir having an open end and a closed end, said open end having a frustoconical socket;

a cap assembly, said cap assembly having a cap end and a frustoconical plug, said frustoconical plug being sized to sealingly engage with said frustoconical socket of said reservoir, said frustoconical plug having a stem projecting axially from said plug;

a cosmetic applicator mounted to said stem; and a reservoir insert fitted inside said reservoir below said frustoconical socket, said reservoir insert having a wiping orifice sized and shaped to wipe said cosmetic applicator.

10. A cosmetic applicator assembly in accordance with claim 9, wherein said frustoconical plug has a plug end located to sealingly bear against an upper end of said reservoir insert.

11. A cosmetic applicator assembly in accordance with claim 9, wherein said cap assembly has a shoulder located to sealingly bear against an end of said reservoir.

12. A cosmetic applicator assembly in accordance with claim 9, wherein said stem is provided with means for mounting said cosmetic applicator.

13. A cosmetic applicator assembly in accordance with claim 12, wherein said means for mounting said cosmetic applicator comprises a bore in said stem, said bore being open at one free end of said stem.

14. A cosmetic applicator assembly in accordance with claim 13, wherein said cosmetic applicator comprises a twisted wire brush assembly mounted to said bore of said stem.

15. A cosmetic applicator assembly in accordance with claim 9, wherein said reservoir insert is retained in said reservoir by a mounting rim at an upper end thereof, said mounting rim being snap fitted into an annular channel extending around an inner surface of said reservoir.

16. A cosmetic applicator assembly in accordance with claim 9, wherein said frustoconical plug and said frustoconical socket of said reservoir are provided with mating screw threads to sealingly attach said reservoir together with said cap assembly.

* * * * *